United States Patent [19]

Verhaegen

[11] 4,441,481

[45] Apr. 10, 1984

[54] HEAT-RECOVERY DEVICE FOR OPEN HEARTH

[76] Inventor: Paul Verhaegen, Saastraat, 22, 9310 Lede, Belgium

[21] Appl. No.: 197,086

[22] Filed: Oct. 15, 1980

[30] Foreign Application Priority Data

Oct. 17, 1979 [BE] Belgium ..... 197681

[51] Int. Cl.[3] ..... F24B 7/00

[52] U.S. Cl. ..... 126/121; 126/163 R; 126/164

[58] Field of Search ..... 126/120, 121, 131, 132, 126/164, 163 R, 143; 237/51

[56] References Cited

U.S. PATENT DOCUMENTS 1,432,551 10/1922 Harper ..... 126/132
2,113,896 4/1938 Moloney ..... 126/132
3,942,509 3/1976 Sasser ..... 126/164
4,185,611 1/1980 Johnson ..... 126/121

FOREIGN PATENT DOCUMENTS 226785 2/1960 Australia ..... 126/121
630017 11/1927 France ..... 126/121

*Primary Examiner*—Lee E. Barrett
*Attorney, Agent, or Firm*—Wood, Dalton, Phillips, Mason & Rowe

[57] ABSTRACT

There is described a device formed by a number of hollow elements mounted next to one another and fastened to one another, which have such a profile that they form at the bottom in the horizontal portion thereof, a grate the fuel bears on, merge backwards into a wall and form at the top, horizontal or substantially horizontal vertically or lateral evacuation pipe(s).

9 Claims, 9 Drawing Figures

HEAT-RECOVERY DEVICE FOR OPEN HEARTH

This invention relates to a heat-recovery device in an open hearth. The invention particularly pertains to a device wherein a forced air flow substantially enhances the efficiency of that open hearth said device is mounted in, due to the resulting artificial convection, relative to open hearths with natural convection. It has already been tried to design devices to be located or built into an open hearth for obtaining a better efficiency from the fuel used, due to a natural or artificial circulation. The following patents describe devices which have the above-defined object in view but which mostly due to the problems resulting from the "thermal impact" not being estimated, are not successful notably due to the too short life duration thereof.

Said patents are the following: Holbek U.S. Pat. No. 1,608,745; Lacoste FR No. 929,047 and Vidall No. 554,586; Welty U.S. Pat. No. 4,163,442; Alexander-Haines U.S. Pat. No. 2,398,265; Hirt FR No. 630,017; Harper U.S. Pat. No. 1,432,551; Moloney U.S. Pat. No. 2,113,896; Sasser U.S. Pat. No. 3,942,509; Johnson U.S. Pat. No. 4,185,611; and Dickinson Aust. No. 226,785. Tomake it clear how far the device according to this invention differs from the above patents, the problem of the "thermal impact" (or thermal stress) will first be considered.

Thermal stresses appear due to irregular heat distribution inside the metal body and cause cracks or distortions in the components due to alternating strong heating and cooling. Naturally the problem of thermal stresses is well known in the metal-working industry, when designing furnaces or hearths. Besides the composition of the materials used, it is of essential importance that the resistance to thermal impact could be increased, which has a direct influence on the structural design of the hearths or devices under consideration here.

It is immediately clear that in devices of the above-described kind, the grate will be very strongly heated locally. Very large temperature differentials may be measured between the center grate portion and the edge portions. The problems of the thermal impact is very acutely present in a device of the kind considered here, in such a way that particular attention must be vested in the air flow in the various components to insure the most suitable distribution of the very hot air without generating undue stresses inside the material.

Therefore outside cold air is collected in the side elements at the back side, directed in separate channels to the front of the system where, due to interconnections with the intermediate elements, air is distributed through the hollow grate-bar part of the system before rejoining the intercommunicating back wall and the exhaust pipe(s). The air in the regions where no heat exchange occurs might become stagnant, allowing the metal to reach transformation temperatures. This problem is most serious at the transition point between the hollow grate section and the hollow back wall. The present invention has overcome this by effective cooling in the rounded construction of the elements at the critical zones.

A particular object of the invention is thus to so design the components and to have same so communicate together that the very hot air will find a free passage through the various components, whereby said discrete components will have less tendency to local overheating and distorsion. A good solution is further provided to activate the fuel by means of air streams which are not in direct contact with the fuel.

For this purpose the device according to the invention is comprised of a number of hollow elements mounted next to one another and fastened together, which have such a profile that they form together in the horizontal portion thereof, a grate the fuel bears on, merge backwards in a wall and connecting thereto, form at the top horizontal or substantially horizontal pipes which sidewise, or frontwise project outwards from said hearth, whereby said elements, comprised of two side elements and a plurality of intermediate elements, are provided with sidewise passageways through which the air to be heated flows from common inlet shafts the sidewise elements connect with, to exit from the device through said pipes.

Preferably each said side element is provided along the one side thereof, with an opening which in the mounted position of said elements face one another and to which connects said inlet shaft for the air to be heated, whereby said side elements are divided at the bottom in said horizontal portion thereof partly into two channels lying one above the other, by means of a horizontal partition, in such a way that the air fed from said inlet shaft enters the lowermost channel, is then discharged through a cut-out in said partition into the uppermost channel to leave thereafter each such side element, on the one hand through said wall and on the other hand through side openings in each side element which forms thereby a continuous duct which extends cross-wise relative to the side element lengthwise axis.

A detail of the invention lies in said lowermost channel in each side element being provided with at least one opening to which may be connected a tube provided with small holes through which combustion air can be led in the direction of the hearth.

Other details and features of the invention will stand out from the following description given by way of non limitative example and with reference to the accompanying drawings, in which.

Figure 1:
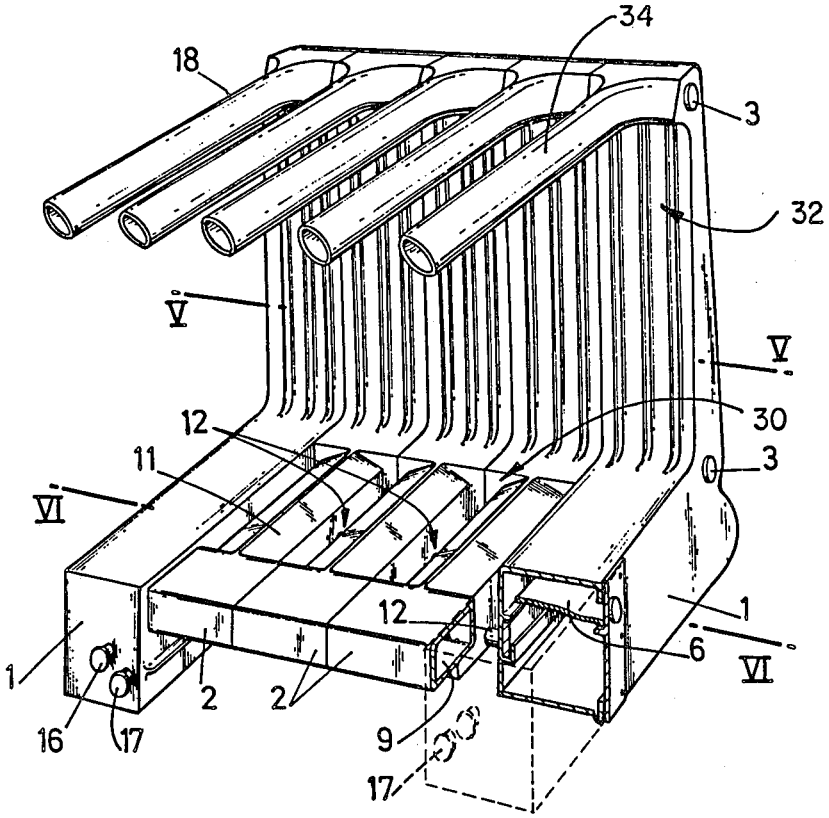
FIG. 1 is a perspective view with parts broken away, of a device according to the invention.
Figure 2:
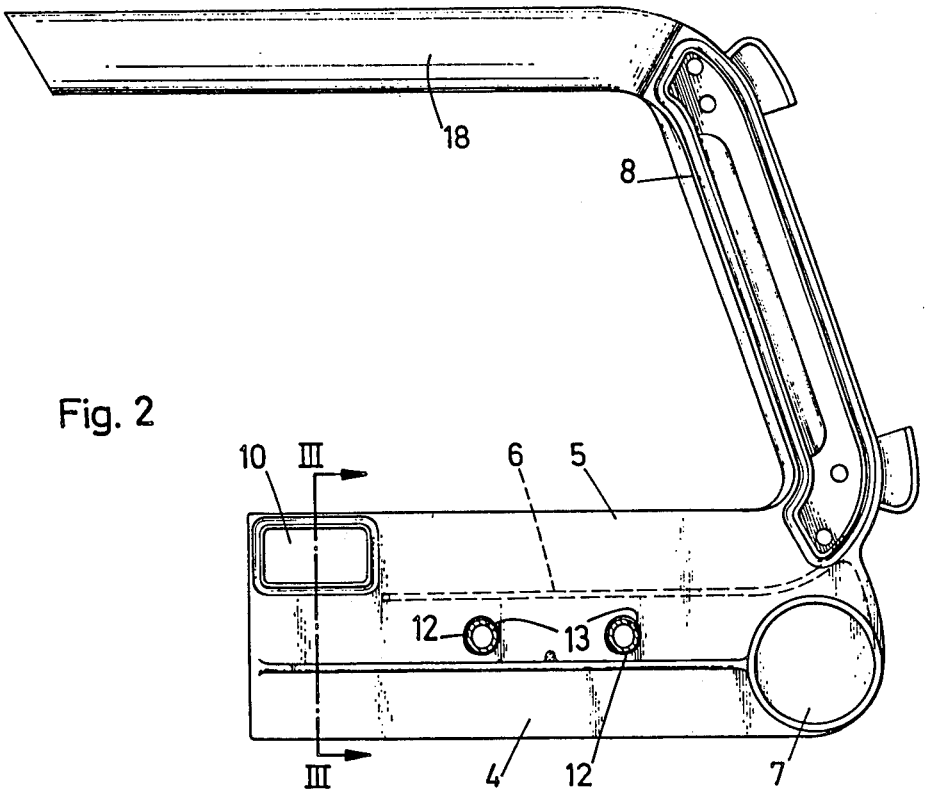
FIG. 2 is a side view, on another scale, of the one side element from the device as shown in FIG. 1, or a similar device.
Figure 3:
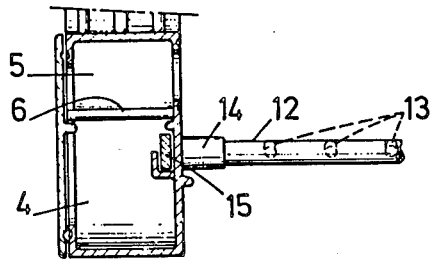
FIG. 3 is a section view along line III—III in FIG. 2.

The device as shown in FIGS. 1, 2, 3 and partly 4, is comprised of elements which are arranged next to one another and fastened together. Said elements are divided into side elements 1 and intermediate elements 2. All said elements are hollow and made from cast iron.

Both said side elements and said intermediate elements are provided in the embodiment as shown in FIGS. 1 to 3, at the bottom with a grate-like portion 30 which extends substantially horizontally, at the back with a vertical or substantially vertical wall 32, and at the top with a plurality of horizontal or substantially horizontal pipes 34 through which the heated air is forced in the space to be heated.

Figure 9:
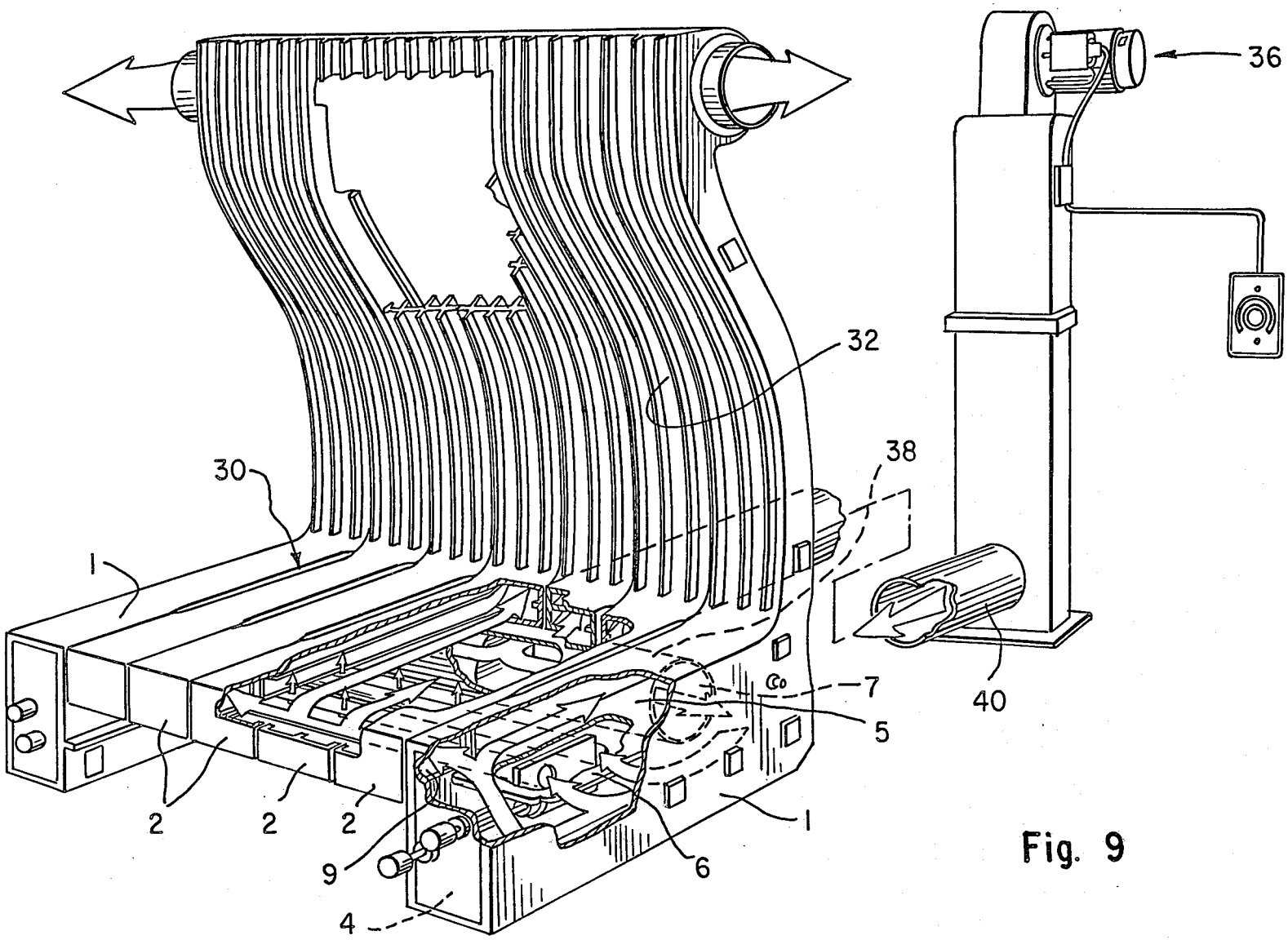
FIG. 9 is a perspective view of a device according to the invention with parts partially broken away to indicate the air flow pattern.

Inside said hollow elements 1 and 2, a forced air flow is supported by means of a fan, as shown in FIG. 9. Said forced air flow causes an artificial convection.

Figure 4:
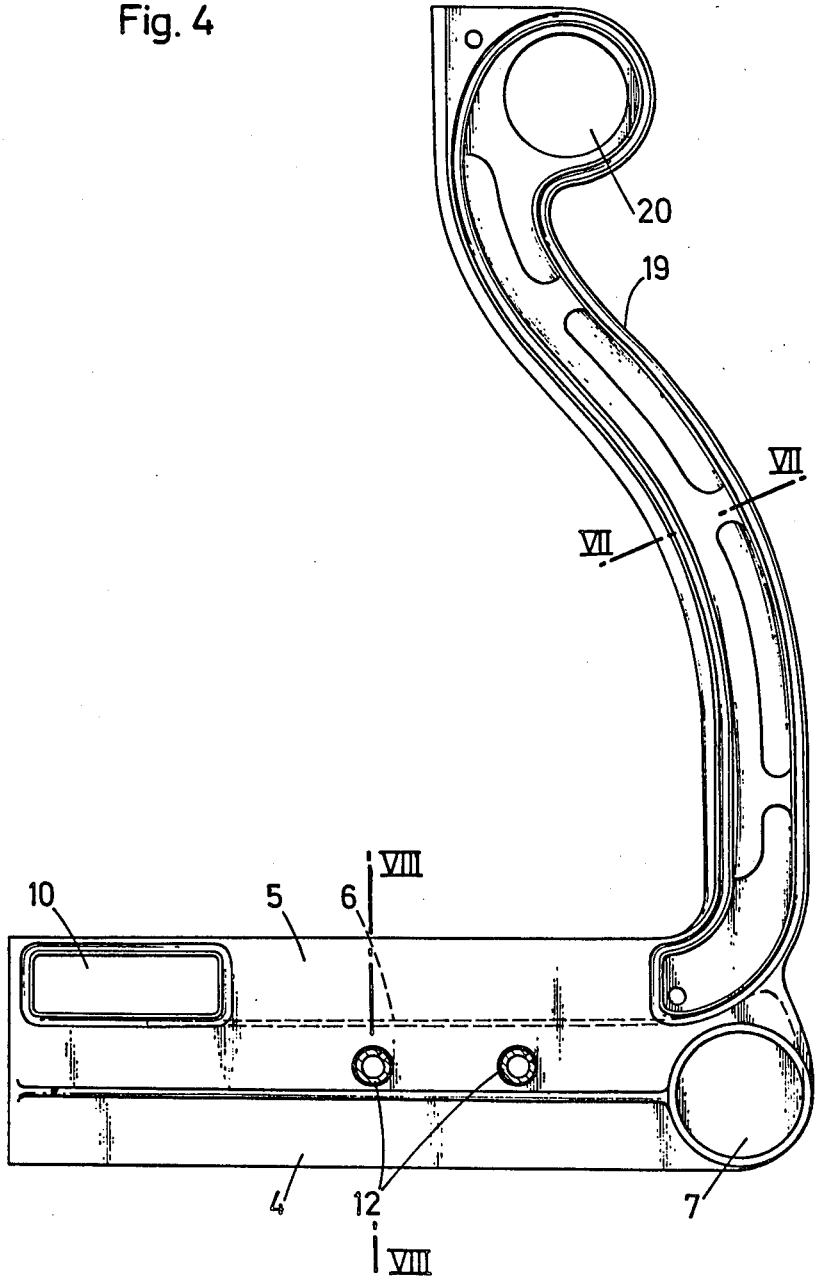
FIG. 4 is a side view of the one side element from a device in another embodiment of the invention.
Figure 5:
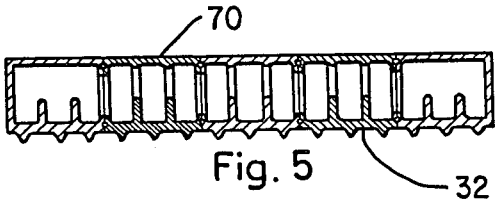
FIG. 5 is a section view along line V—V in FIG. 1.
Figure 6:
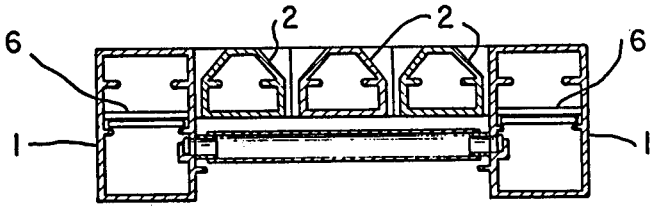
FIG. 6 is a section view along line VI—VI in FIG. 1.

Both in the embodiments as shown in FIGS. 1 and 2 and in the embodiment as shown in FIG. 4, the bottom of said side elements 1 forms the bearing means for the device, while the top surface of the horizontal portion from said side elements 1 and the lowermost horizontal portion from said intermediate elements 2, forms a grate 30 whereon the fuel such as wood, coal, lignite, etc. bears.

All of the elements the description of which follows are pressed together and made fast to one another by means of connecting rods 3.

With particular reference to FIGS. 2, 3, 5, 6 and 9, it will be noted that each side element 1 forms a hollow chamber which isdivided horizontally into two channels. The lowermost channel bears reference numeral 4 and the uppermost channel the reference numeral 5, while a horizontal lengthwise partition 6 separates both channels over the major part of the length of said side element portion. At the bottom and on the back side (on the right in FIG. 2) is provided a passageway 7 which connects to a common inlet shaft 38 for the air to be heated. Each one of both side elements 1 has such a passageway 7 directed to the device inner side, while said common inlet shaft 38 for the air to be heated is comprised of a number of segments the total useful length of which corresponds to the width of those various intermediate elements which are enclosed between two side elements. One segment among said segments forming said common inlet shaft has a special shape whereby said segment can connect to a duct 40 which leads in turn to a fan.

The fan-pulsed air reaches through the common inlet shaft, said passageway 7, channel 4, below partition 6, and uppermost channel 5. The air to be heated which has already been partly heated, then reaches passageway 6 and is distributed partly through channel 5 and in the front, interconnected intermediate elements and through passageways 10.

On the back side, the various side elements 1 and intermediate elements 2 retained against one another, form a wall which bears the general reference numeral 8. Said wall runs preferably at an angle upwards. As all of the intermediate elements are open on both sides and each one of said side elements is open sidewise on the inner side, the air flows freely behind said wall 8. Along the front side the air is discharged from the frontmost portion (on the left in FIG. 2) out of channel 5, to reach chambers 9 which are present on the device front side inside each one of said intermediate elements.

The various hollow chambers 9 thus connect axially to passageway 10 which allows the flow of said air to be heated between channel 5 and said grate-like portion of intermediate elements 2.

According to a possible variation, said grate-like portion of intermediate elements 2 has in a cross-section relative to the lengthwise axis thereof, a substantially triangular shape which merges at the bottom into a rectangle. Other geometrical shapes are naturally also possible. Between the various grate-like chambers 11 of the intermediate elements 2 and between each one of the side elements 1 and an adjacent grate-like portion of chamber 11 from an intermediate element, is also provided a space. This is necessary to let the air flow between portions 11 in the direction of the hearth.

To further enhance said air flow, tubes 12 having openings 13 (FIGS. 3, 4, 5 and 6) are mounted between the inward-facing mouth pieces of said side elements 1. Said mouth pieces 14 lie at the level of the lowermost channel 4. Use is thus purposefully made according to the invention, of tubes 12 with openings 13 which are spaced from the fuel. Should the air-flow openings be provided in the grate elements proper, there would have to be expected damage by burning of said openings or choking thereof.

A damper or register 15 having one or a plurality of passageways, closes the opening of said mouth pieces 14 or lets air flow from the lowermost channel 4 to tubes 12.

In FIG. 1 is shown a control rod 16 by means of which the position of damper 15 can be changed. A second control rod 17 acts on a valve which insures the usual flow-rate adjustment for the device.

In the uppermost portion of said device, those various elements which form wall 8, merge into horizontal or substantially horizontal pipes 18. The various pipes are separated from one another and they have preferably an oval shape the long axis of which coincides with the lengthwise symmetry plane of elements 1 and 2.

The hot flue gases rise to the chimney not shown and cause a substantial heating of pipes 18. The air flowing through said pipes and discharged from the device is thus further strongly heated.

Figure 7:
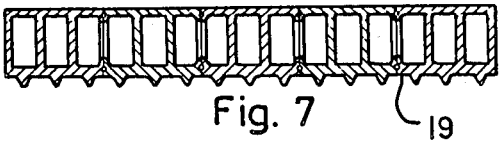
FIG. 7 is a section view along line VII—VII in FIG. 4.
Figure 8:
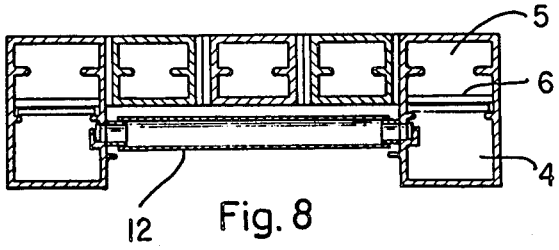
FIG. 8 is a section view along line VIII—VIII in FIG. 4.

In the embodiment as shown in FIG. 4, a side element has been shown in another embodiment of the device according to the invention. In such embodiment, the profile of the back wall 19 has been changed, while the lowermost portion of the side elements and intermediate elements remains substantially unchanged. Said element differs essentially by the corrugated profile of said wall 19 as seen in FIG. 7. Such profile is particularly advantageous to obtain an optimized heat exchange between the gases and the wall metal.

In the uppermost part, the various elements forming said back wall 19 do not merge into horizontal pipes of the type described in connection with FIGS. 1 and 2. According to this variation there is provided above those elements which comprise the device shown in FIG. 4, a passageway 20 which can connect sidewise to sleeves or tubes, not shown. Said sleeves or tubes let the heated air escape sidewise from the brickwork of the open hearth.

The variation according to the FIG. 4 is mainly designed to be built-in into the open hearth brickwork during the construction thereof.

In each one of the above-described variations, the invention has very large possibilities because the extent, mostly the width of the device can be adapted either to an existing structure or to an open hearth being built.

In both embodiments, mostly in the variation as shown in FIG. 4, part of the device, particularly the wall 19 can form a heat exchanger for an amount of water, said exchanger being connected to or part of a central heating installation.

It appears very clearly from the above description that the problem as defined in the preliminary part, of the thermal impact has been solved in a very suitable way. Indeed due to the mutual communicating of the side elements 1 and intermediate elements 2 mostly where said elements form the back wall 8, there is obtained a very good distribution of the hot air inside said elements. A possible local overheating of said elements is first of all not to be feared as this is the case when the elements are comprised of separate passageways, and a higher temperature of one or a plurality of said elements has no damageable results on the stresses generated in the back wall. Slight distortions of the metal said elements are made of, may be well absorbed by the usually required (not shown) asbestos seals which lie between two elements.

A distortion which might occur locally in a back wall formed by a one-piece metal sheet, would have very serious consequences in the whole structure of said back wall. The same would be true when those elements which form a back wall or might be considered as equivalent thereto, do not communicate with one another over a substantial portion of the height thereof. The stresses which appear in such a case have unavoidably very severe results at the location of the bottom or top connection between the elements the position or the function of which may be compared to the back wall in the device according to the invention.

It must be understood that the invention is in no way limited to the above embodiments and that many changes can be brought therein without departing from the scope of the invention as defined by the appended claims.

I claim:

1. An apparatus for recovering heat in an open hearth comprising:

a plurality of elements including at least two side elements and a plurality of intermediate elements, each having a hollow pathway permitting the passage of air between an inlet and outlet end, said elements effecting heat exchange between a burning fuel and the air traversing the pathways said side elements each including:

a horizontal partition in the pathway defining an upper and lower chamber;

an inlet for the introduction of unheated air into the lower chamber;

a first opening in the partition and spaced from the inlet to the lower chamber for admitting air from the lower chamber into the upper chamber; and a second opening for introducing air from the upper chamber into the intermediate elements at a position spaced from the wall, said second openings so situated as to be facing each other in a lateral direction;

whereby the air introduced to the lower chambers is admitted to the upper chambers from where it diffuses both through the second openings to the intermediate elements and through the upper chambers to the wall and is thereafter exhausted through the pipe;

means connecting said elements in such a manner as to define a grate for the placement of the fuel and a wall merging with and extending away from the grate;

at least one pipe in communication with said hollow pathways for exhausting heated air carried by the elements;

means communicating between an unheated air source and the inlets of the hollow pathways; and means for intercommunicating air between the element pathways intermediate the inlet and outlet ends of the elements and thereby preventing an uneven heat distribution as might cause damaging thermalstresses within the apparatus.

2. The apparatus of claim 1 wherein means are provided to force unheated air through the apparatus at the inlet to the lower chamber.

3. An apparatus for recovering heat in an open hearth comprising:

a plurality of elements including spaced side elements and a plurality of intermediate elements between the side elements, each element having a hollow pathway to permit the passage of air between an inlet and an outlet;

means connecting said elements in such a manner as to define a grate for the placement of fuel and a wall merging with and extending away from the grate;

a partition in the pathway of the side elements defining an upper and lower chamber;

an inlet in each side element for the introduction of unheated air into the lower chamber;

an opening in the partition permitting passage of air from the lower chamber to the upper chamber; and means communicating air between the upper chambers of the side elements and the inlets to the intermediate elements;

whereby air introduced at the inlets of the side elements diffuses through the lower chambers and simultaneously through the pathways of the intermediate elements and the upper chamber of the side elements and is exhausted at the outlet ends.

4. The apparatus of claim 3 wherein means communicate directly between the lower chambers of the spaced side elements to further enhance air flow characteristics.

5. The apparatus of claim 4 wherein said means communicating between the lower chambers comprises at least one mouthpiece about an opening in a wall of each side element and a hollow tube, the ends of which mate telescopically with the mouthpiece.

6. The apparatus of claim 5 wherein a plurality of openings are provided in the tube to release air from the lower chambers into the hearth.

7. The apparatus of claim 5 wherein a damper is provided to selectively open and close the opening in the wall of at least one of the side elements.

8. An apparatus as in claim 3, in which those elements forming said wall have a corrugated profile with top sidewise openings, in such a way that the openings from said intermediate elements and side elements lie in the extension of one another and connect to one another, while the openings directed outwards of the side elements are extended sidewise outwards to let the heated air escape from a structure inside which said device is mounted.

9. An apparatus for recovering heat in an open hearth comprising:

a plurality of elements each having a hollow pathway to permit the passage of air between an inlet and an outlet end where heated air is expelled;

said elements including at least two spaced side elements and a plurality of intermediate elements between the side elements;

a partition wall dividing the pathway in each side element into an upper and lower chamber;

a first opening communicating between the upper and lower chamber in each side element;

a second opening communicating between each of the upper chambers and the inlets to the intermediate elements; and an inlet to admit unheated air to each lower chamber;

whereby the air introduced to the lower chamber is heated gradually as it traverses through the lower and upper chambers and to the inlets of the intermediate elements, thereby minimizing the possibility of a thermal shock resulting from a great heat differential.

* * * * *